United States Patent [19]

Alday et al.

[11] 4,005,695

[45] Feb. 1, 1977

[54] TOURNAMENT TRAP

[75] Inventors: James Marion Alday, Williamson; Kenneth Charles Rowlands, Utica, both of N.Y.

[73] Assignee: Remington Arms Company, Inc., Bridgeport, Conn.

[22] Filed: June 12, 1975

[21] Appl. No.: 586,207

Related U.S. Application Data

[62] Division of Ser. No. 417,185, Nov. 19, 1973, Pat. No. 3,937,204.

[52] U.S. Cl. ..... 124/8; 124/36; 124/32

[51] Int. Cl.[2] ..... F41B 3/04

[58] Field of Search ..... 124/8, 9, 32, 36, 43, 124/48, 49, 50, 47, 41

[56] References Cited

UNITED STATES PATENTS

| | | | |
|---|---|---|---|
| 2,310,746 | 2/1943 | Parker et al. | 124/47 |
| 2,652,820 | 9/1953 | Darrell | 124/8 |
| 2,711,726 | 6/1955 | Darrell | 124/47 X |
| 3,612,025 | 10/1971 | Rhodes | 124/8 |
| 3,621,828 | 11/1971 | Hansen | 124/8 |
| 3,822,688 | 7/1974 | Mayne | 124/47 X |

*Primary Examiner*—Richard C. Pinkham
*Assistant Examiner*—William R. Browne
*Attorney, Agent, or Firm*—John H. Lewis, Jr.; Nicholas Skovran; William L. Ericson

[57] ABSTRACT

A target throwing apparatus in which a revolving magazine having a number of stacks of targets is independently and fixedly supported relative to an oscillating target throwing housing. A cocking means stops the throwing arm just before reaching the over-center position whereupon initiating of the next cocking cycle throws the target. A power train consists of three equal-sized gears mounted on three parallel shafts to throw the targets and to oscillate the housing. The magazine includes a ramp and cam means by which the entire column of targets is lowered by gravity prior to having springbiased fingers engage the second target from the bottom and having the lower-most target fall onto a predetermined drop pad on a target launching plate, which pad location does not change regardless of the position of the oscillating housing and launching plate. A scotch yoke assembly is utilized in translating rotary shaft motion to symmetrical reciprocating motion to oscillate the housing. The targets are located and positioned on the drop pad by a nylon brush means which is adjustable to vary the point at which the target leaves the platform. The throwing arm also includes an adjustment for target curl.

5 Claims, 15 Drawing Figures

68
128
58
76
26
30
12
74
2
72
70
4
60
88
86
16
34
28
14
10
18
64
24
32
102
98
146a
3
146
148
152
20

74
72
128
12
60
58
26
14
86
112
70
110
76
54
50
38
30
48
34
28

TOURNAMENT TRAP

This is a division of application Ser. No. 417,185 filed Nov. 19, 1973, now U.S. Pat. No. 3,937,204.

This invention relates to target traps of the type used for throwing clay targets for such shooting sports as skeet and trap. More particularly, the invention relates to target traps which are autoloading and autoangling, e.g. can be repeatedly fired merely by depressing a button or actuating a switch each time a target is required. Still more particularly, the invention relates to a target trap which automatically varies the direction a target is thrown.

In order to be useful in the sport of trap shooting, it is necessary that the trap project the targets in directions which cannot by anticipated by the shooter. Various mechines have been built and some patented which address themselves to the solution of this problem. Without going into great detail regarding the various prior art traps, it is generally conceded in some of the later patents that some of the early traps resulted in an experienced shooter being able to guess fairly closely where subsequent targets would be thrown. This resulted in an unfair advantage since the shooter could then call for the machine to throw the target in a preferred direction.

Later machines and patents tended to prohibit this "guessing" and in fact did project targets in random and unascertainable directions. These machines, however, tended to be bulky and expensive to build.

It is an object of the present invention to provide a novel target trap which is not only economical to build and maintain but which occupies a minimum of space.

It is another object of this invention to provide a novel power train which is compact and eliminates the complex gearing of prior art devices.

It is another object of this invention to provide a novel and simple method of cocking the throwing arm without the use of a sear and firing mechanism.

Further objects will be obvious from the following description taken in connection with the accompanying drawings in which.

Figure 1:
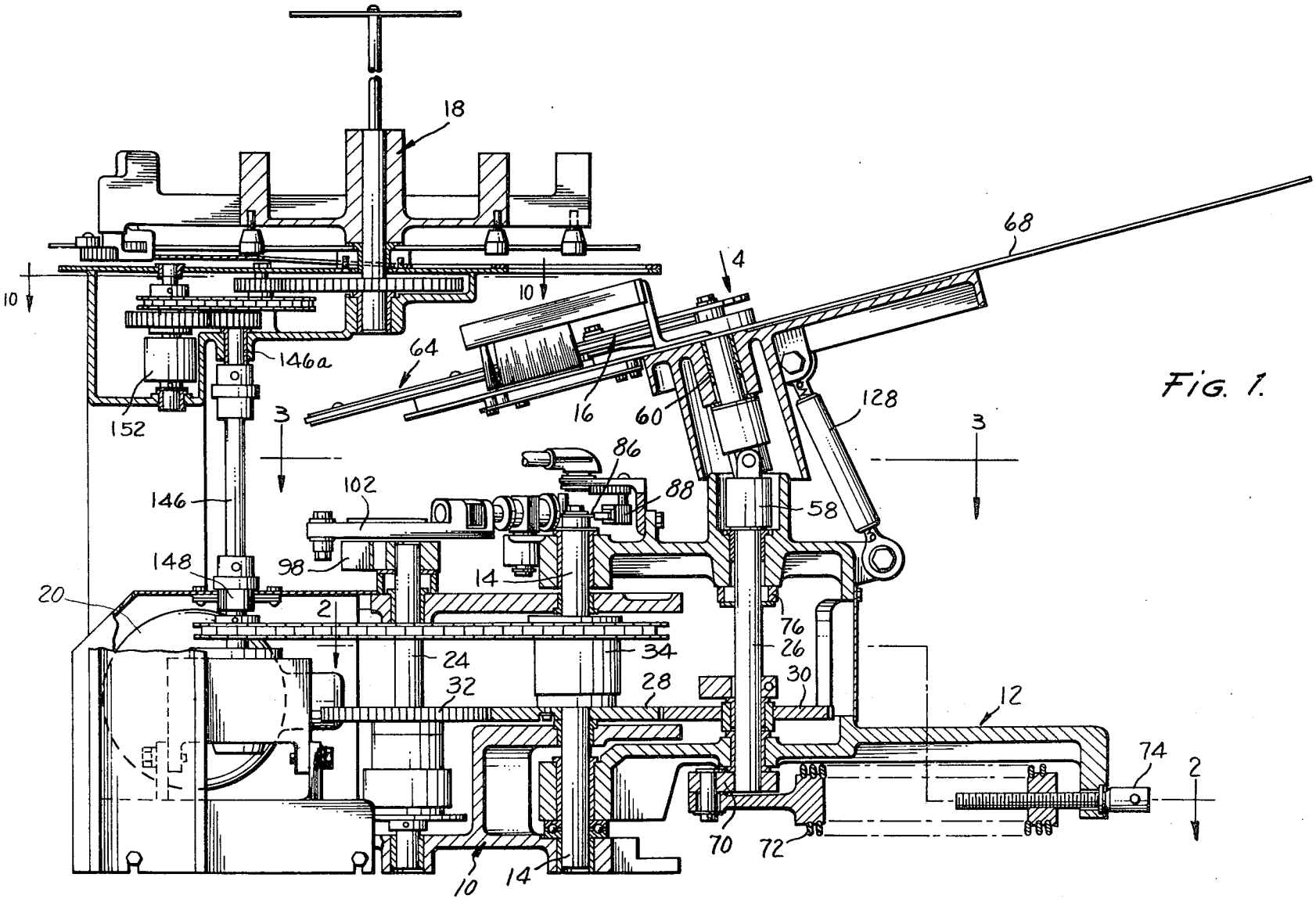
FIG. 1 is a side elevation view of a preferred embodiment of the invention.

In accordance with the present invention, there is provided a stationary base 10 and a main shaft housing 12 pivotally connected thereto by means of a vertical pivot shaft 14. A target-throwing mechanism 16 is mounted on said housing in a manner described later, and a magazine assembly 18 for holding and feeding individual targets to said throwing mechanism is attached to said stationary base 10 to overlie the target-throwing mechanism.

Figure 5:
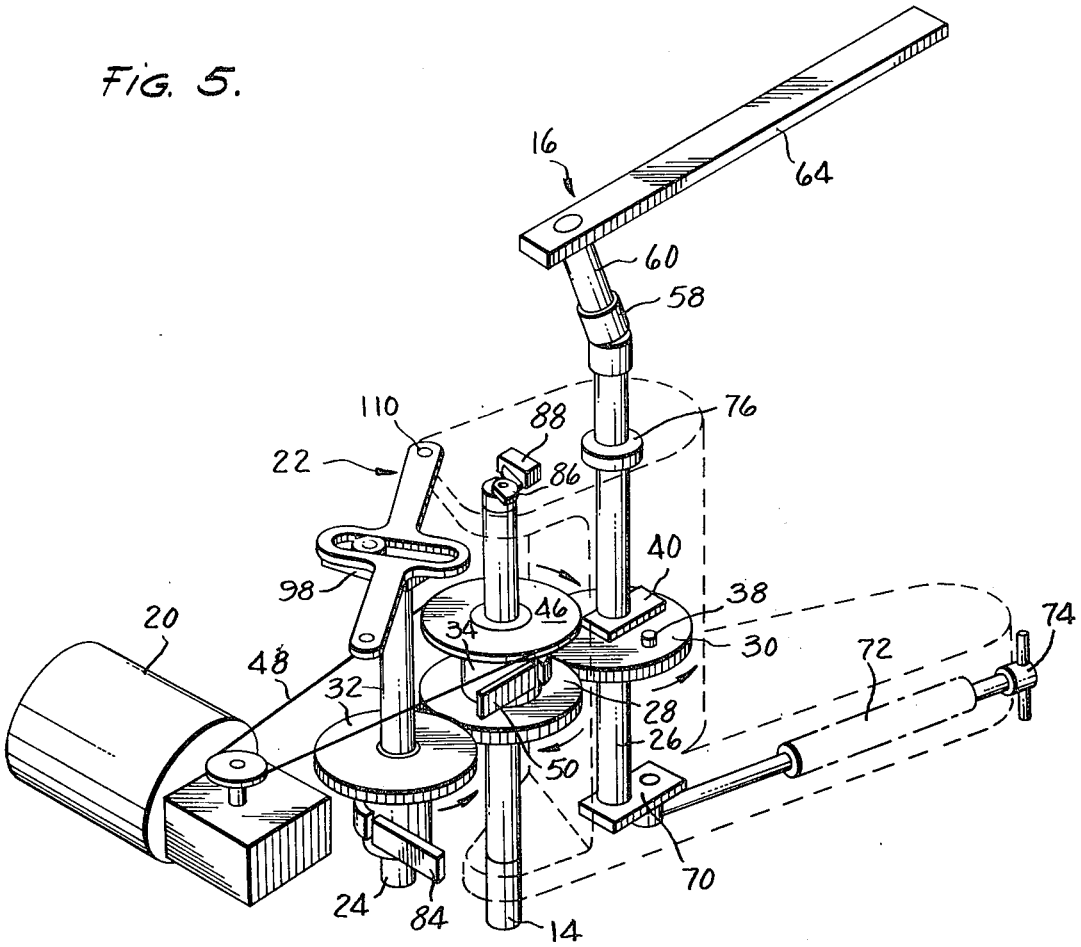
FIG. 5 is an isometric view of the power train of the trap, with some of the elements not necessarily in the proper phase relationship in order to show the parts. The proper phase relationship of the sears, etc. is shown in FIG. 2.

The basic power train means is shown in isometric view in FIG. 5.

In addition to vertical pivot shaft 14, there are two other vertical shafts which are used to transfer the power from main motor 20 to the throwing mechanism 16 and an angling system 22. Angling shaft 24 and main shaft 26 are parallel to and spaced an equal distance away from the pivot shaft 14. The three parallel shafts are each mounted in bearings (not numbered) and each carries an identical sized gear, i. e. a pivot shaft gear (or cocking clutch gear) 28, a main shaft gear 30, and an angling shaft gear 32. The pivot shaft gear 28 and the angling shaft gear 32 are connected to their respective shafts by a cocking clutch 34 and an angling clutch 36 respectively. Main shaft gear 30 runs freely about the main shaft 26 and is operatively connected thereto by a pin 38 which is attached to and protrudes upwardly from the main shaft gear to engage a drive arm 40 which is rigidly secured to said main shaft 26 (FIG. 5).

As can be seen from FIG. 5, when the pivot shaft gear 28 rotates clockwise, the main shaft gear 30 and the angling shaft gear 32 will be caused to rotate counter clockwise. The main shaft gear 30 will rotate freely on the main shaft until the pin 38 engages the edge of the drive arm 40 whereupon the main shaft will now be caused to rotate.

Figure 14:
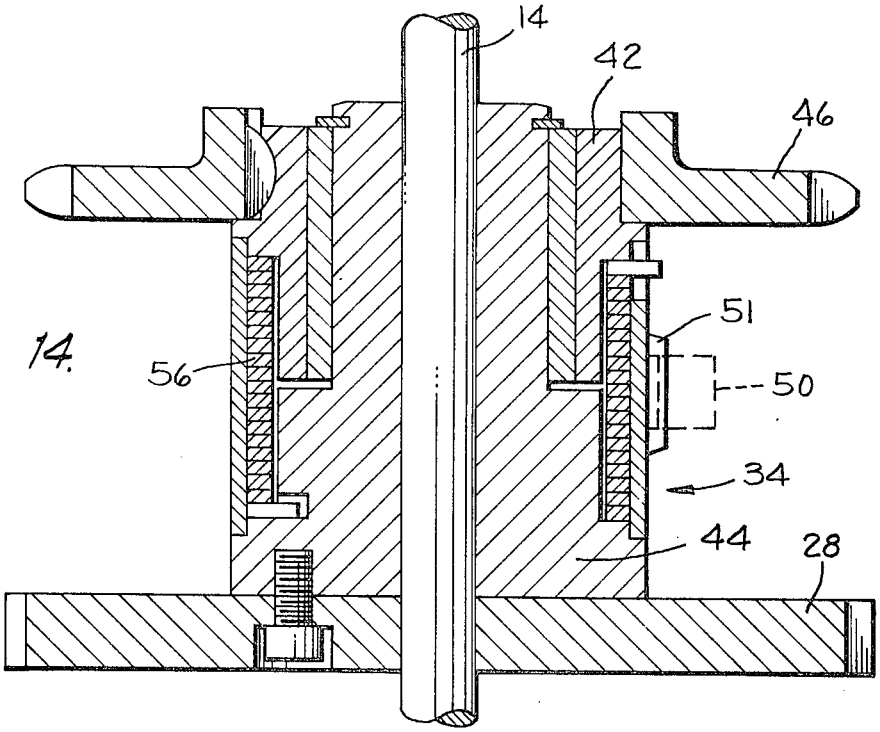
FIG. 14 is a cross-sectional view of the pivot shaft and the cocking clutch assembly.
Figure 15:
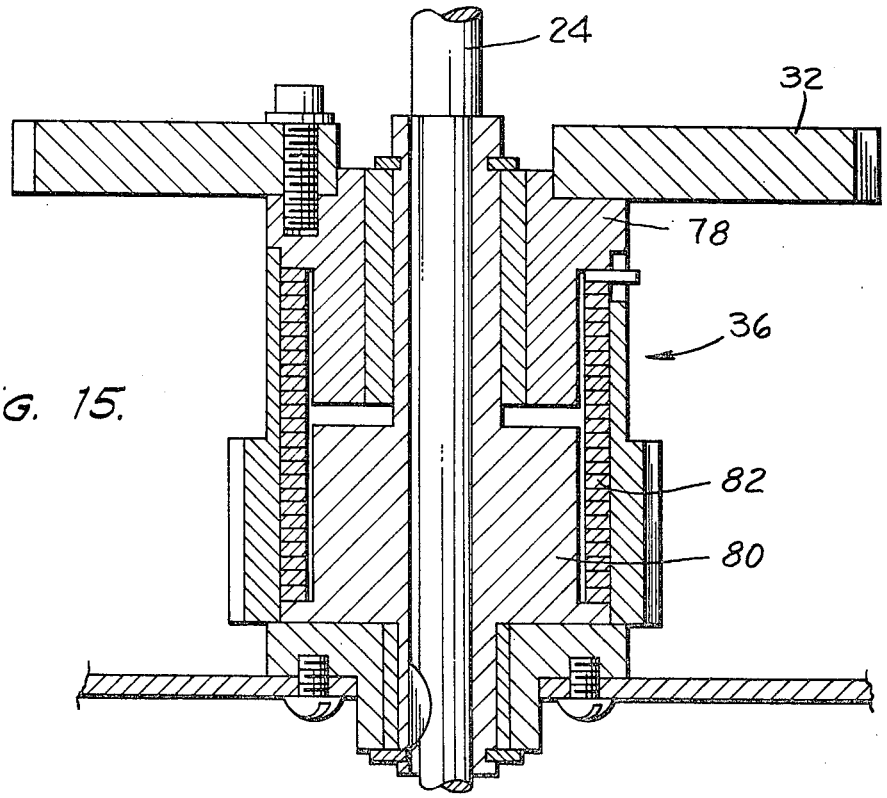
FIG. 15 is a cross-sectional view of the angling shaft and the angling clutch assembly.

The connection between the pivot shaft gear 28 and the pivot shaft 14 by means of the cocking clutch 34 is shown in FIG. 14. Clutch 34 is preferably a spring-wrap type of clutch which has a power input portion 42 and a power output portion 44. The output portion 44 of the clutch and the pivot shaft gear 28 are fixedly secured to said pivot shaft 14 and the input portion 42 of the clutch is attached to a sprocket 46 which in turn is driven by motor 20 by means of a drive chain 48. The sprocket 46 and input portion 42 of the cocking clutch rotate freely on the pivot shaft in non-power transmitting relationship when the clutch is not engaged.

The cocking clutch allows power transmittal only when the outer sleeve or portion is released from pawl stop 50. Pawl 50 is pivotally mounted on a clutch actuating bracket 53, which is rigidly mounted on main shaft housing 12 (see FIG. 2). Since housing 12 oscillates, the bracket 53 and pawl 50 also oscillate thus ensuring that the end of the pawl 50 is moved through an arc and does not always stop at the same point. This is necessary for random target throws. If the bracket and pawl did not move with the housing, the throwing arm would stop at a point fixed relative to the stationary base 10, rather than a point fixed relative to the angling main shaft housing 12. Upon closing of a push-button switch 52, which is external to the trap (FIG. 13), a cocking clutch solenoid 54 is activated, thus moving pawl 50 out of a notch 51 in the outer shell of the cocking clutch (see FIG. 14). This action allows the spring coil 56 inside the cocking clutch to contract, engaging the clutch and pivot shaft 14, and its attached pivot shaft gear 28. Since the output portion 44 of the cocking clutch 34 and pivot shaft gear 28 are keyed to pivot shaft 14, the power is now transmitted from the sprocket 46, through the cocking clutch 34 to the pivot shaft 14 and pivot shaft gear 28.

Main shaft gear 30 and angling shaft gear 32 turn at the same speed as pivot shaft (or cocking clutch) gear 28 but in the opposite direction.

Figure 4:
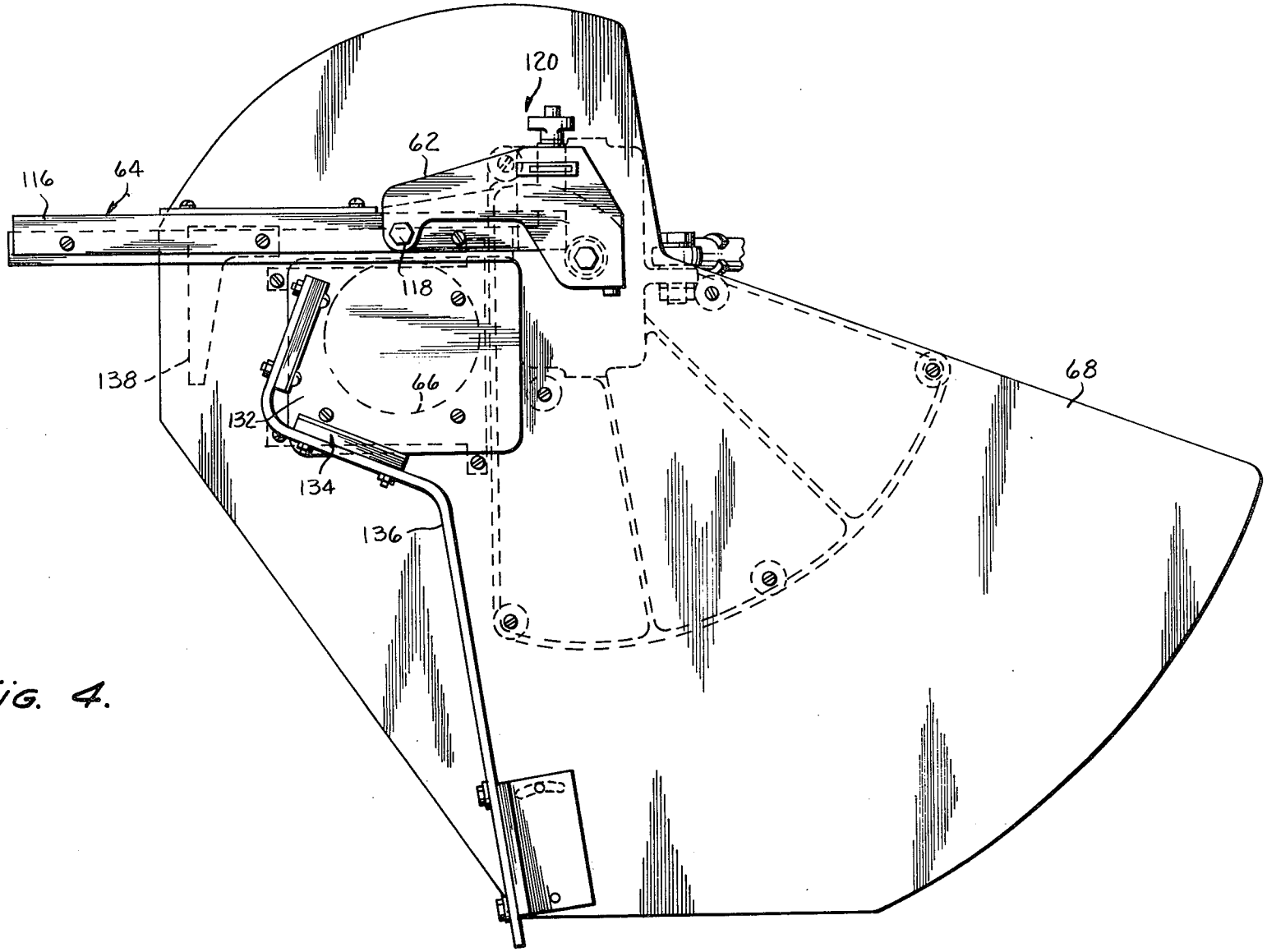
FIG. 4 is a plan view taken in the direction of arrow 4 of FIG. 1.

The target throwing mechanism 16 is related to the main shaft 26 and will be described at this point. See FIG. 8 for a clear view of the various components of this mechanism. Rotating main shaft 26 carries universal joint 58, universal shaft 60, and the throwing arm 64 (see FIG. 1), which accelerates and spins the clay target 66 as it sweeps around and across the launching platform 68 (FIG. 4). Fixedly connected to the bottom of main shaft 26 is main shaft crank arm 70. Mainspring 72 is attached at one end to the end of crank arm 70 and at the other end to an adjustment screw assembly 74, which in turn is connected to the front end of main housing 12. Adjustment of the throwing force is accomplished by turning the adjustment screw in or out to vary the tension of the mainspring.

Figure 2:
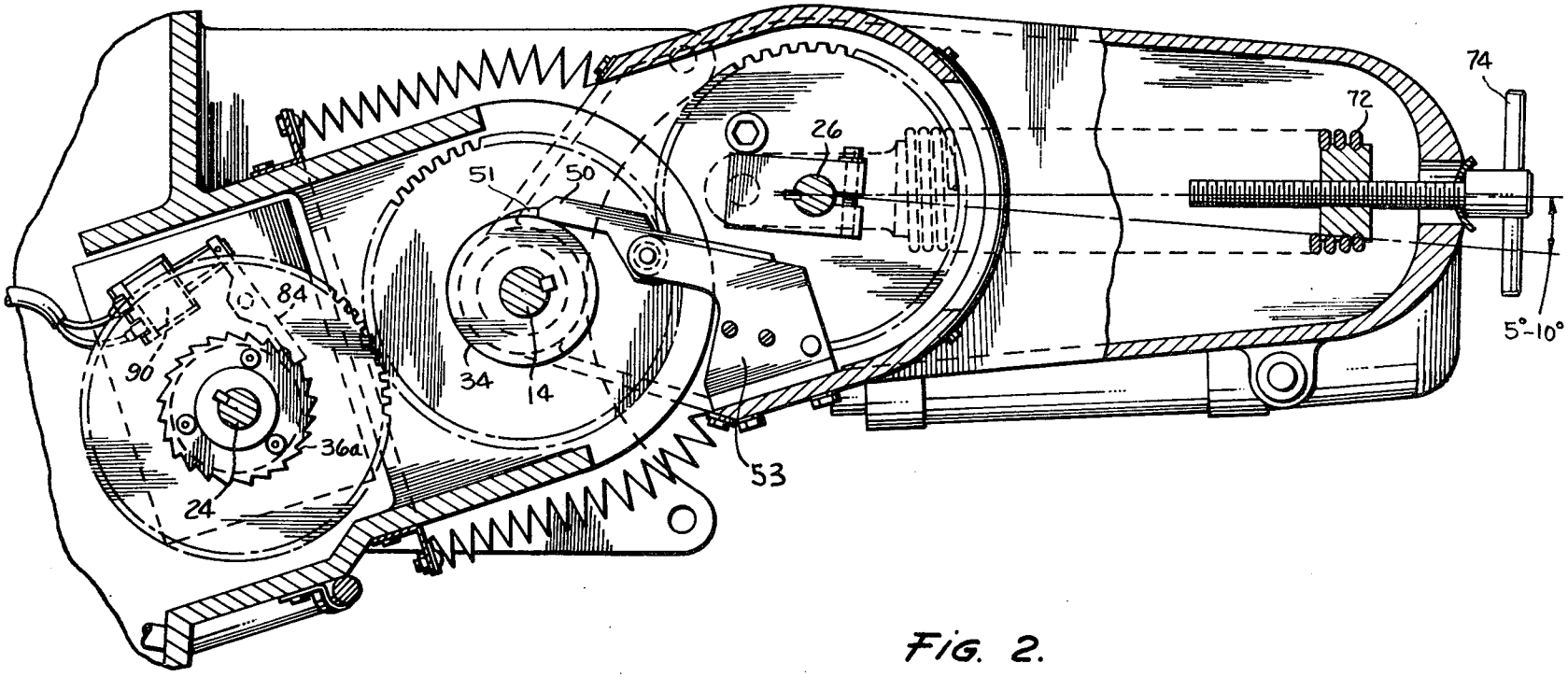
FIG. 2 is a plan view taken along lines 2—2 of FIG. 1.

The cocked of the throwing arm is shown best in FIg. 2. In contrast with the conventional type of cocking means where the mainspring is caused to move "over-center" and then be held in this cocked position by a sear or some similar means, the cocked position of the present invention is reached when the pull of the mainspring is about from 5° to 10° before top dead center, as shown in FIG. 2. When this position is reached, the notch 51 of the outer sleeve of cocking clutch 34 engages pawl 50, assuming the release switch has been opened since the target was thrown, and the pivot shaft 14 is disengaged from power, leaving the mainspring cocked and the trap ready for the next target.

To fire the trap, it is necessary to actuate a push-button switch 52 (FIG. 13) which activates cocking clutch solenoid 54 to withdraw pawl 50 and thus cause the cocking clutch to engage and move the main shaft 26 via pin 38 and arm 40 until the mainspring 72 moves the 5° to 10° to the "over-center" point whereupon the mainspring contracts to rotate main shaft 26 and associated throwing arm 64. Main shaft 26 can travel freely for nearly a complete revolution relative to main shaft gear 38. It is to be noted that when the target is thrown, the re-cocking cycle is already in operation, for it was the initiation of the cocking cycle that actually caused the target to be thrown. As main shaft gear 30 is rotated, it does no work until pin stop 38 again contacts arm 40 attached to main shaft 26 and then carries it around to the cocked position, expanding the mainspring 72.

Main shaft 26 is locked against reverse rotation under the pull of mainspring 72 in the cocked position by one-way clutch 76, preferably a sprag clutch, which is attached to the housing in which shaft 26 rotates. Also, after the target is thrown, the remaining inertia in the throwing arm assembly causes partial re-cocking of the mainspring and this one-way clutch 76 prevents backlash and whipping of the throwing arm.

While the re-cocking of the trap was occurring, a new angle of throw was being selected. As pivot or cocking clutch gear 28 was turning, angling gear 32 was being rotated in addition to main shaft gear 30. Gear 32 is attached to a freely-rotating input member 78 of clutch 36 and in a fully ready state rotates freely relative to angling shaft 24. Angling clutch 36 also includes an output member or portion 80 which is rigidly connected to angling shaft 24 and a spring means 82 which engages the clutch and the shaft 24 when the clutch is operative so as to rotate the shaft in the same manner as the cocking clutch 34. Angling clutch 36 has a number of notches **36*a* (see FIG. 2) into which its pawl 84 may fall giving a number of possible positions in which the oscillating main shaft housing 12** may stop. The number of notches that are advanced each cycle is varied by two different cam and micro-switch assemblies.

Figure 7:
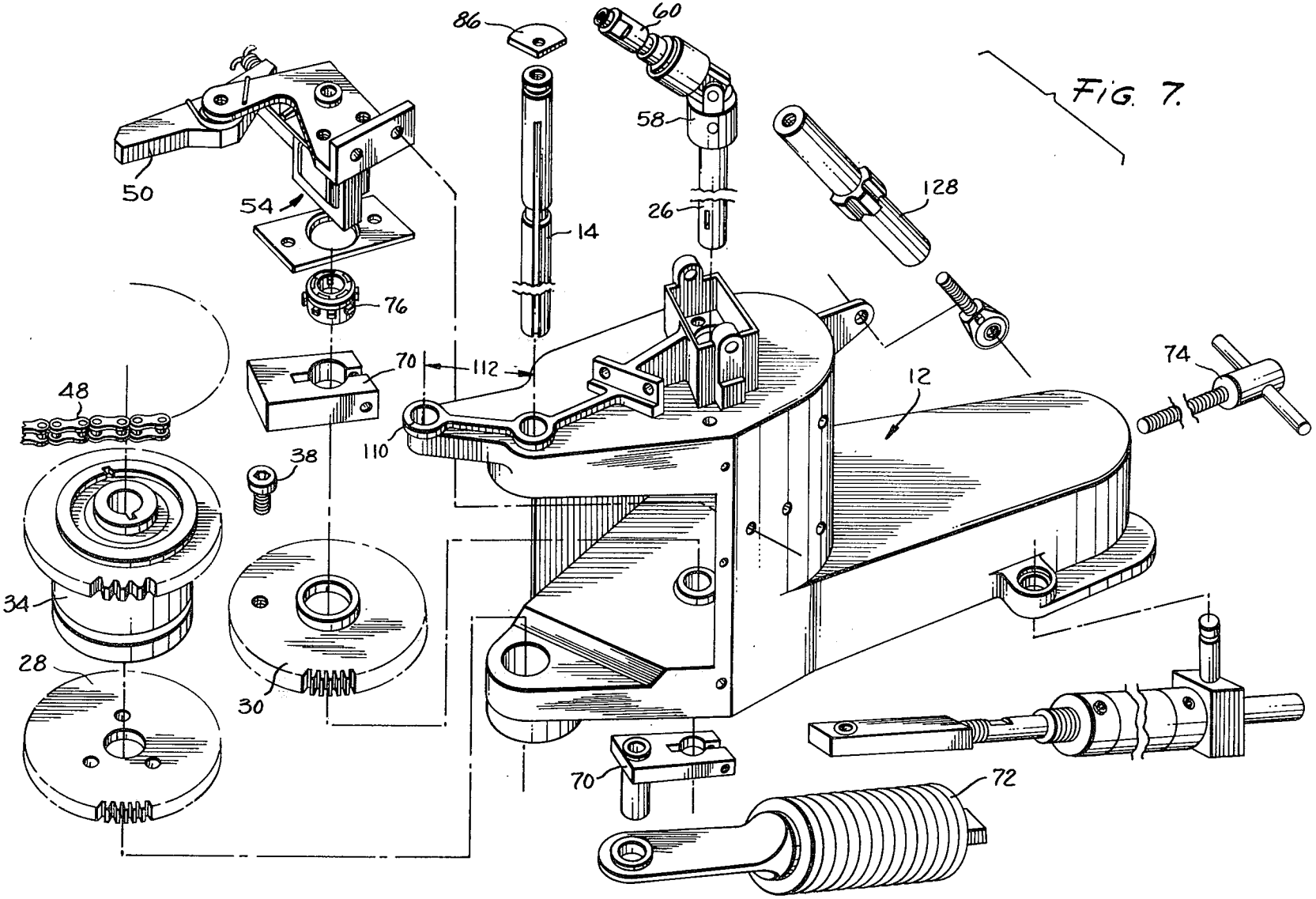
FIG. 7 is another exploded view showing the pivotable main shaft housing, the pivot shaft, and the main shaft assembly.

The first pivot shaft cam 86 and micro-switch assembly 88 (FIGS. 5 and 7) are located atop the pivot shaft 14 and serve to limit the time of angling to a portion of the cocking cycle when little force is being exerted in stretching the mainspring 72. This is approximately the first ½ of the cocking cycle before contact of stop pin 38 and arm 40. At this time all the power of the motor is available for angling and later all the power is available for cocking.

Pivot shaft cam 86 closes switch 88 almost immediately after inception of rotation of pivot shaft 14. The delay is only enough to allow the target to clear the launching platform 68 so that its flight will not be disturbed.

If the solenoid 90 of the angling clutch 36 (FIG. 6) were connected directly to power by means of this switch 88 alone, angling of the trap would occur throughout the first ½ of the cocking cycle resulting in a nearly uniform change of angle between any two successive targets, and consequently a good shooter would soon be able to anticipate the direction of his next target, making his shots easier and defeating the auto-angling trap principle.

Figure 13:
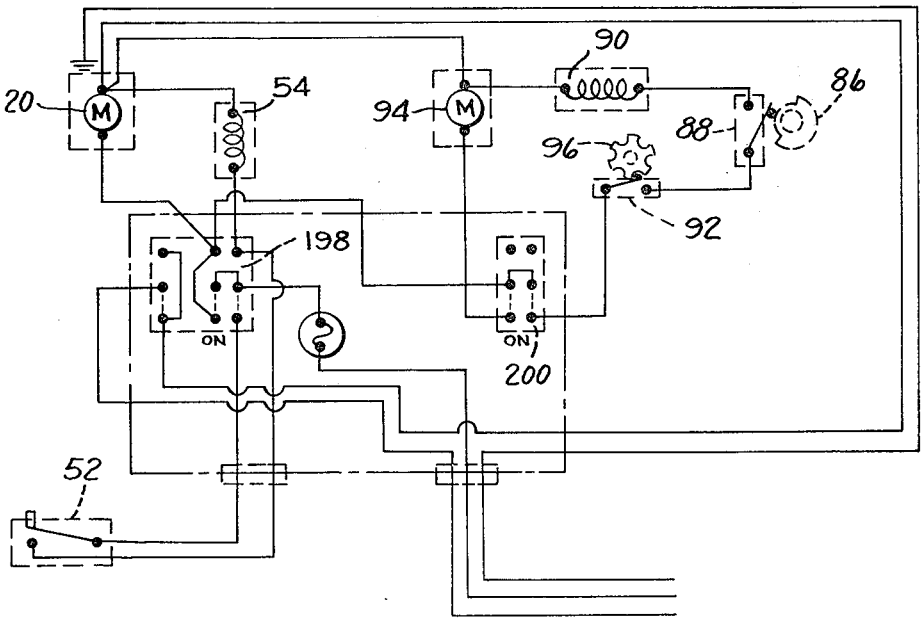
FIG. 13 is a wiring diagram of the electrical circuitry of the trap.

To prevent this occurrence, a second micro-switch 92 (FIG. 6) is wired in series with switch 88 (see FIG. 13). This second switch 92 is operated from a timing motor 94 which operates continually Motor 94 turns timing cam 96 at about 6rpm. This cam 96 has several lobes of varying duration and several blank spaces which close the switch for time intervals from zero up to the same length of time as pivot shaft cam 86 closes its switch 88 during the recocking cycle.

The result of this arrangement is that upon throwing one target, the trap then recocks and it may move angularly from nothing to approximately its total sweep. That means that the next target could be thrown in exactly the same place or it could be thrown at an opposite extreme, if the first target had been thrown near the limits of travel to one side of center.

The fact that there are approximately 10 different intervals of time of oscillation available, and the timing motor 94 is continually alternating these times, makes it impossible to anticipate accurately the direction of flight of successive targets.

The angling mechanism 22 can now be described in greater detail. (See FIGS. 1, 5, 6, and 7)

Figure 6:
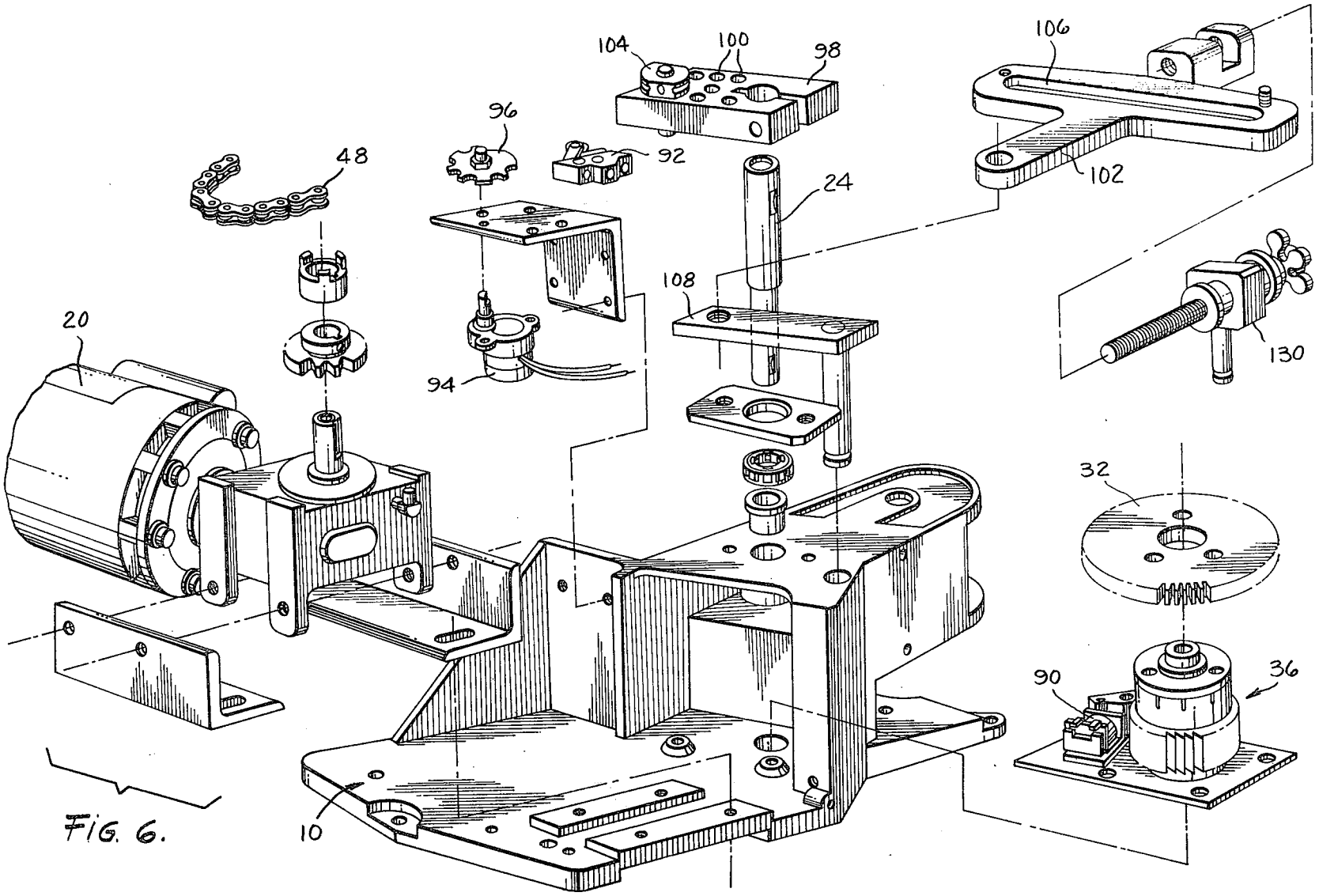
FIG. 6 is an exploded view of the stationary base member, the angling shaft means, and the angling yoke assembly.

Attached to the top end of angling shaft 24 is an angling crank arm 98 which rotates when angling shaft 24 rotates (FIG. 6). A number of openings 100 are located in crank arm 98 (FIG. 6) at different radii from the center of rotation of the crank arm, i.e. center point of angling shaft 24. An angling yoke 102 is positioned above crank arm 98 and is slidably connected thereto by a pin 104 which is positioned in one of crank arm openings 100 and in angling yoke slot 106 which runs at right angles to the axial direction of the angling yoke. This mechanism is commonly known as a "scotch yoke" assembly.

The rear end of the angling yoke 102 is pivotally connected to one end of an angling link 108 which in turn is pivotally mounted on the stationary base 10. The length of angling link 108 is important and will be discussed below. The opposite end of angling yoke 102 is pivotally connected to main housing 12 at a point 110 which is located from the pivot shaft 14 a lateral distance which is approximately the same as the length of angling link 108. The moment arm 112 is defined by a line connecting the center of pivot shaft 14 and point 110 (see FIG. 3). It is important that moment arm 112 is approximately the same length as and parallel to angling link 108 so as to effect symmetrical left and right throws. It will be understood that it is important to get symmetrical motion of the trap so that there is a symmetrical distribution of the targets.

The angling mechanism 22 translates the rotational movement of angling shaft 24 to a reciprocating movement of angling yoke 102. The amount or length of reciprocating movement of angling yoke 102 depends on which opening 100 in the crank arm 98, the pin 104 is inserted. Upon turning of the shaft 24 — and crank arm 98 — the pin 104 slides in slot 106 while the near end of angling yoke 102 is pivoting on link 108 and exerting a forward or backward reciprocating force on the main shaft housing 12 at the end of moment arm 112 (at point 110) thereby causing oscillation of the main shaft housing 12 about stationary base 10.

As mentioned previously, the angling yoke 102 provides symmetrical division of angles to either side of center position, whereas simple crank mechanisms, such as are used in some present models, do not provide such symmetrical division. Link 108 is used to balance the offset at the front of the angling yoke to maintain symmetry of system and keep the axis of the scotch yoke parallel at all times.

Figure 8:
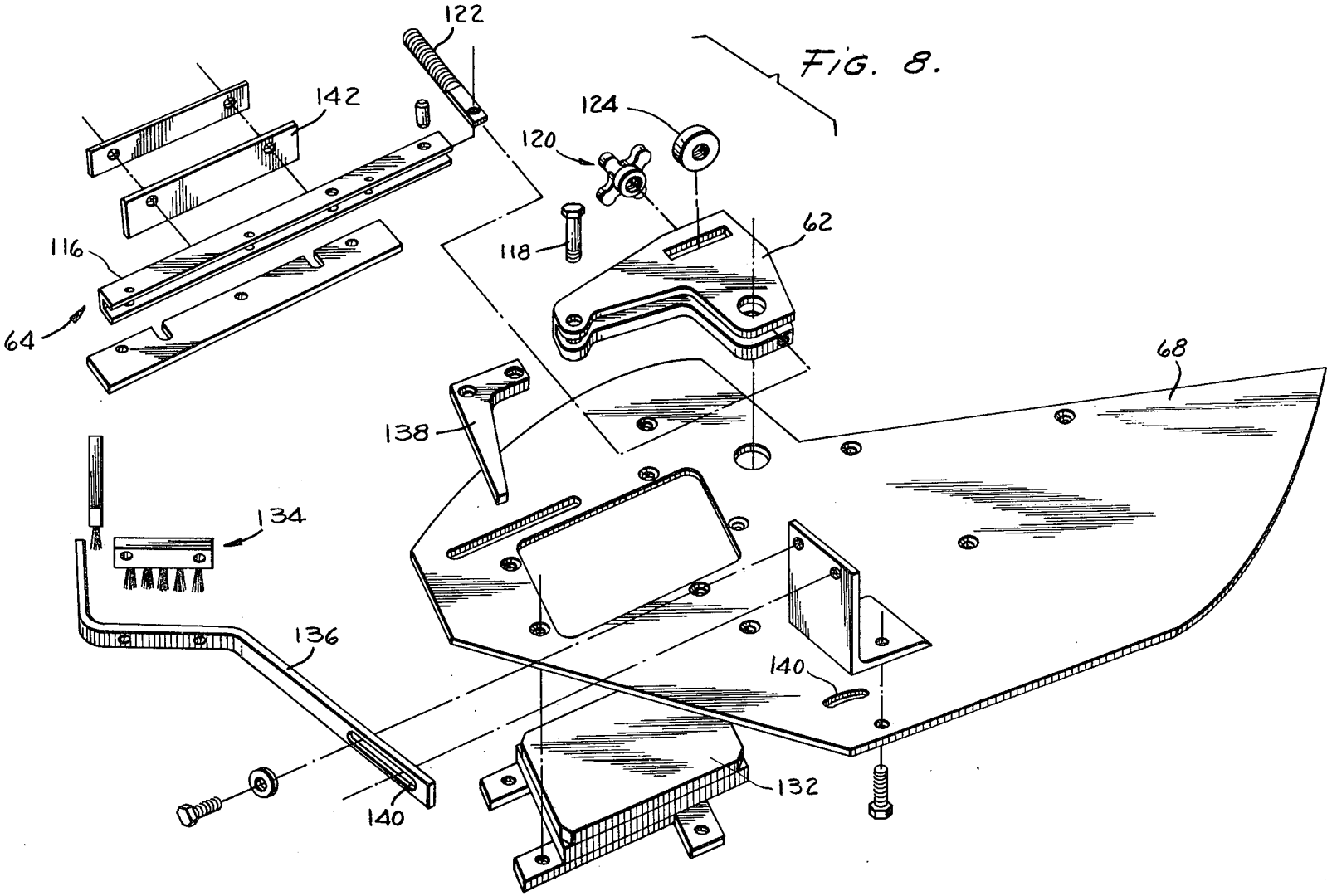
FIG. 8 is an exploded view showing the launching platform and the throwing arm.

FIGS. 4 and 8 show the best views of the target throwing apparatus including the launching platform 68 and the throwing arm 64. Throwing arm 64 includes an L-shaped carrier portion 62 which is fixedly connected to the universal housing shaft 60 which is mounted on main shaft 26. The throwing arm also comprises a rail portion 116 which is pivotally connected to said carrier portion 62 by a bolt 118 or any other conventional means. An adjusting means 120 is provided to alter the angle of the throwing arm rail 116 relative to the target 66 (shown in broken lines in FIG. 4) and launching platform 68. The adjusting means 120 comprises a screw means 122 attached to the carrier portion 62 and connected to a nut 124 and to the end of the rail portion 116. If the nut 124 is turned so that the screw 122 is moved inwardly, the rail 116 will be pivoted clockwise about bolt 118 to alter the angle of the throwing arm. The effect of this variation is to adjust the point at which the target leaves the launching platform relative to the plane of flight that the platform creates. If the target is thrown from the platform earlier than for a straight, flat flight, it will curl to the right, and if it leaves later or more degrees counter-clockwise about the platform it will curl to the left.

Other adjustments are possible, e.g. adjustment of the throwing force is accomplished by turning adjustment screw assembly 74 (see FIG. 1) in or out to vary the tension on the mainspring 72.

Another adjustment is the varying of the vertical angle of departure by turning knob 128 (see FIG. 1). The ends of the knob have right and left hand threads and tip the throwing arm carrier 62 and the attached platform 68 relative to the main housing 12, and consequently horizontal.

Adjustment of the angle of sweep of the possible target paths (described previously) is secured by placing pin 104 in a variety of openings 100 in crank arm 98. This alters the throw of the scotch yoke assembly and consequently the angle through which the main shaft housing 12 may move relative to the stationary base 10.

Figure 3:
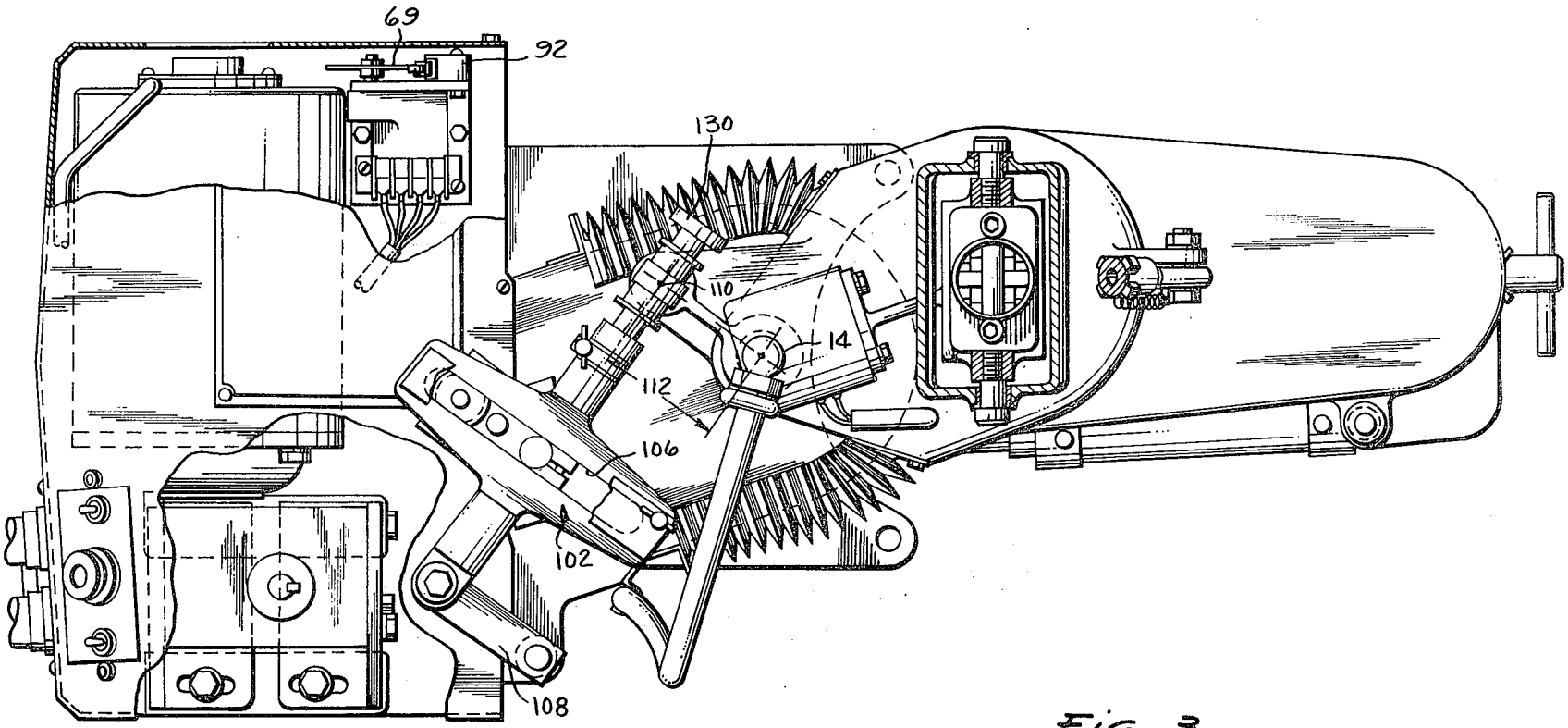
FIG. 3 is a partial plan view taken along lines 3—3 of FIG. 1.

Windage adjustment is secured by turning windage adjusting screw assembly 130 in or out of yoke 102 (FIG. 3). This varies the center of the arc within which the targets are thrown from left to right.

Associated with the launching platform 68 are some features of or attachments to the platform which should be discussed before proceeding with a discussion of the magazine assembly 18.

The area of the launching plate 68 where the target lands, i.e. from the magazine assembly 18, is called a drop pad 132 and consists of a platform made of aluminum or other material which rests on or is backed by a sponge rubber pad cushion to prevent breaking the target in its fall from the magazine to the launching platform.

The laminated drop pad, e.g. aluminum with sponge rubber, provides a relatively dead surface for the target to fall upon from the magazine and prevents excessive bounce as well as being a resilient area so the target has less tendency to break.

Surrounding the drop pad 132 is a target locating and positioning means comprising a V-shaped target nest brush means 134 with the bristles, e.g. nylon, nearly touching the launching platform. This brush means 134 keeps the target from sliding off the drop pad and keeps the target in the correct throwing position on the platform while allowing the throwing arm 64 to sweep through and pick up the target without interference. The V-shaped brush means 134 actually is shown in the drawing (FIG. 4) as two separate brushes mounted on an elongated target nest arm 136 which is itself mounted rigidly to the launching platform out of the way of the sweep of the throwing arm.

In a modification to be explained later, target stop 138 can be moved toward universal shaft 60 to curl the target to the left, and may be moved outwardly to curl the target to the right.

Summarizing, the advantages of the target nest arm with brushes are: (1) It keeps the target in proper position on the launching platform. The platform is inclined and slight vibration when the trap is running causes the target to center itself in the apex of the Vee brushes; (2) It provides a larger area where the target can be dropped from the magazine due to the self-centering feature described immediately above under Item 1); (3) It allows the throwing arm to sweep under the brushes and remove the target without interfering with the motion of the target, or its rotation outward on the throwing arm; (4) The brush system allows easy adjustment for curl. By adjusting the brushes more toward the axis of the throwing arm, right curl is corrected and by adjusting away from the axis, left curl is corrected.

The brush adjustment can be accomplished by furnishing an adjustable connection between the end of the target nest arm 136 and the bracket fixed on the launching platform. See FIG. 8 where a simple bolt and slot 140 means is provided at this point.

It can be seen from FIG. 4 that the target nest arm 136 with brushes 134 can be removed and a conventional stop — shown in dotted lines in FIG. 4 as target stop 138 — can be used, either for singles or doubles. As explained above, stop 138 is slidably mounted on the platform in any well known manner (see FIG. 8).

Attached to the rear of the throwing arm 64 is a throwing arm wiper 142 preferentially elastomeric which projects down from the bottom of the throwing arm to close relationship with the launching platform. Its function is to remove any pieces of a broken target which either might remain on the launching platform after a broken target has been fed from the magazine or is broken on the platform. If the pieces of target are allowed to remain in the drop pad area, as the new target falls from the magazine it can land on the broken pieces causing it to break, or the new target may rest on the broken pieces so that it will have erratic flight when it is thrown.

The magazine assembly 18 can now be described as it relates to the operation of the target throwing apparatus, or trap as it is commonly called.

The magazine assembly 18 is attached to the stationary base 10 of the trap so that the magazine remains stationary while the angling mechanism of the trap selects a new throwing direction for the next target. However, the magazine rotates 1/7th of a revolution (could be more or less depending on the nunber of stacks of targets desired) each time a target is thrown, permitting another target to drop onto the launching platform, ahead of the throwing arm. In the modification shown, there are seven stacks of targets, each of which contains approximately 40 targets maximum, assuming adequate vertical room is available for stacks that high.

The whole magazine attachment is fastened to the base of the trap with bolts or other fastening means to two legs 144 which then carry the remainder of the mechanism and suspend it above the trap so that when actuated it will merely drop a target onto the launching plate of the trap in the appropriate position for the throwing arm to pick it up and project it in the proper direction (see FIG. 1).

Figure 12:
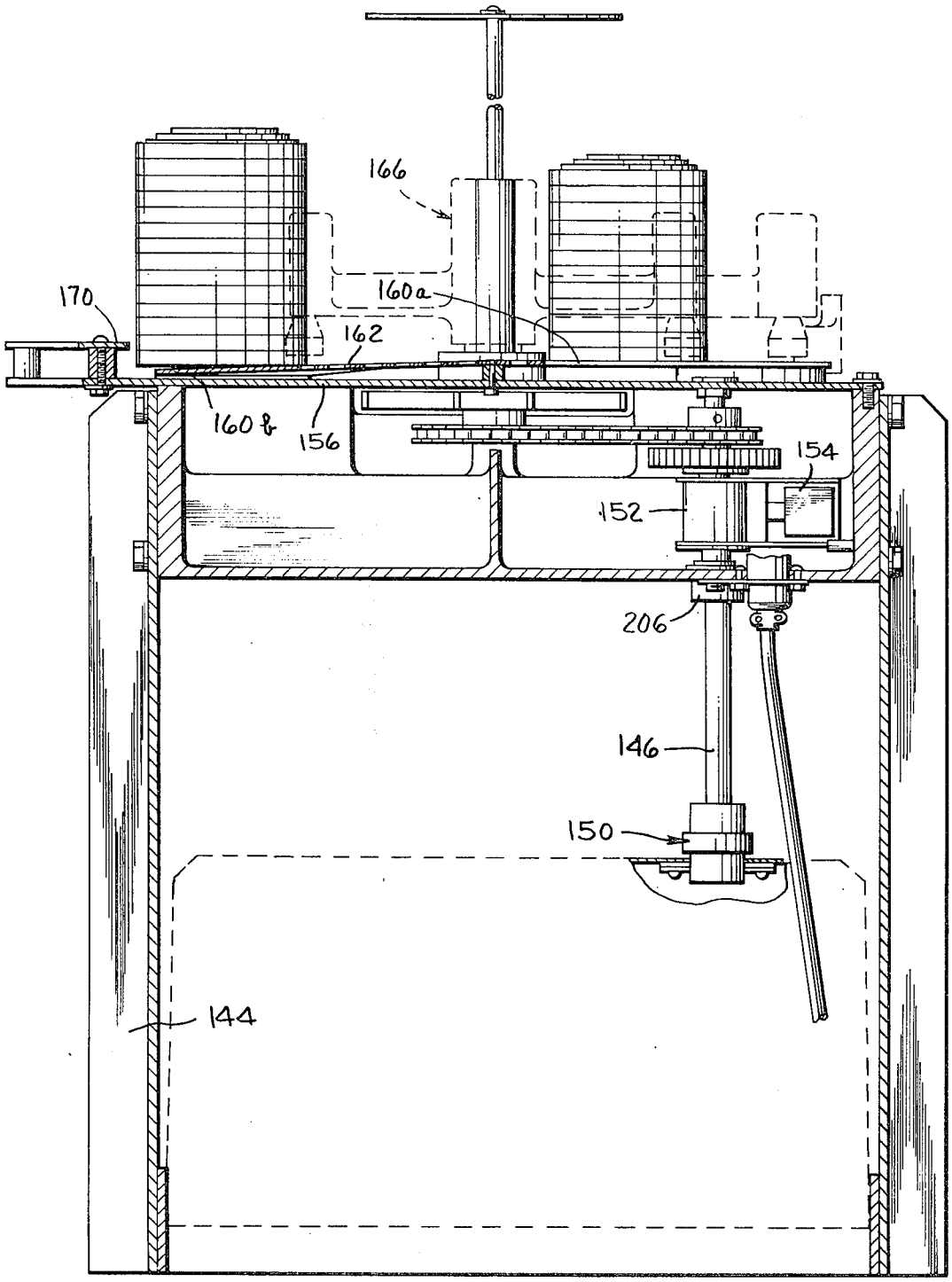
FIG. 12 is an elevational view taken along lines 12—12 of FIG. 11.

The only other connections between the magazine and the trap are the drive shaft 146, which is connected to magazine input shaft **146*a* by coupling 206, and the electrical cord and its connector (see FIG. 12**).

Figure 10:
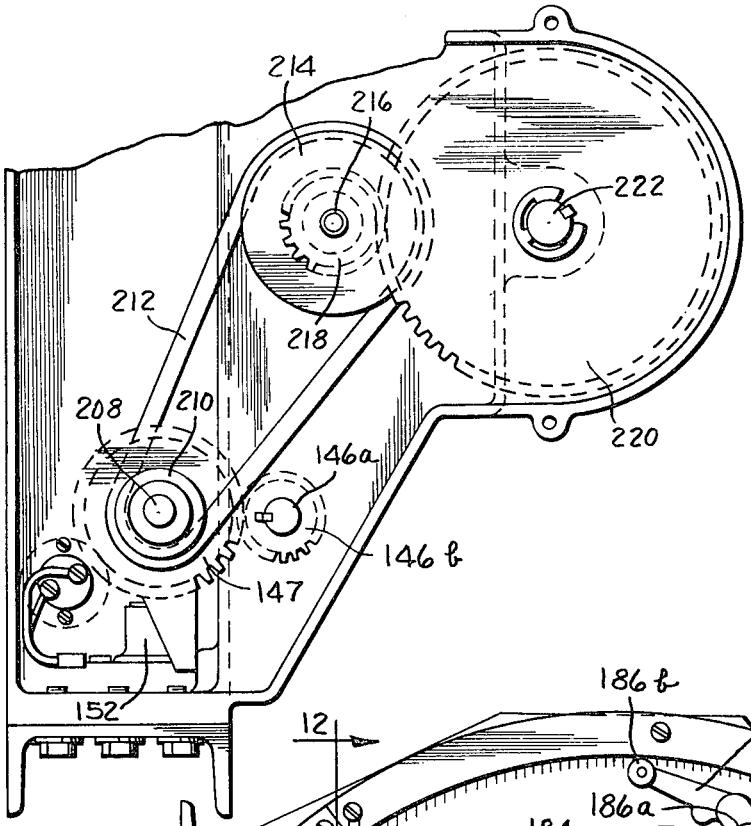
FIG. 10 is a partial plan taken along lines 10—10 of FIG. 1.

Power to the magazine is supplied by the gearbox of the trap which normally supplies power for cocking and angling (see FIG. 1). The output shaft 148 of main motor 20 is on top of the gearbox and by merely adding a coupling 150 (FIG. 12) and shaft 146 vertically through a hole in the cover of the motor compartment a drive for the magazine is created. This shaft 146 and associated shaft **146*a* turn at all times the trap is in operation. Power is transmitted from input shaft 146*a* to clutch 152 by means of gear 146*b* through clutch gear 147. Clutch 152 is hooked in electrically parallel with the cocking clutch solenoid 54 of the trap and is actuated directly by the push botton 52 used to throw the target. Clutch 152 is mounted on magazine clutch shaft 208 and when in power-transmitting-relationship transmits power through clutch sprocket 210 through chain 212 to idler sprocket 214 mounted on idler shaft 216 on which idler gear 218 is mounted. Gear 218 in turn rotates the large magazine main shaft gear 220 which is mounted on magazine shaft 222 which carries the magazine and revolves it. See FIG. 10**.

Each time the button 52 is pushed, the cocking clutch solenoid 54 is energized which throws the target and recocks the trap. At the same time the magazine clutch solenoid 154 is operated, it allows the magazine clutch output to rotate one turn. With the gearing used, the one turn will rotate the entire magazine one seventh of a turn, indexing the next one of the seven total stacks of targets. Obviously other gearing combinations are possible which would allow for more or less than seven stacks of targets to be properly indexed.

Figure 9:
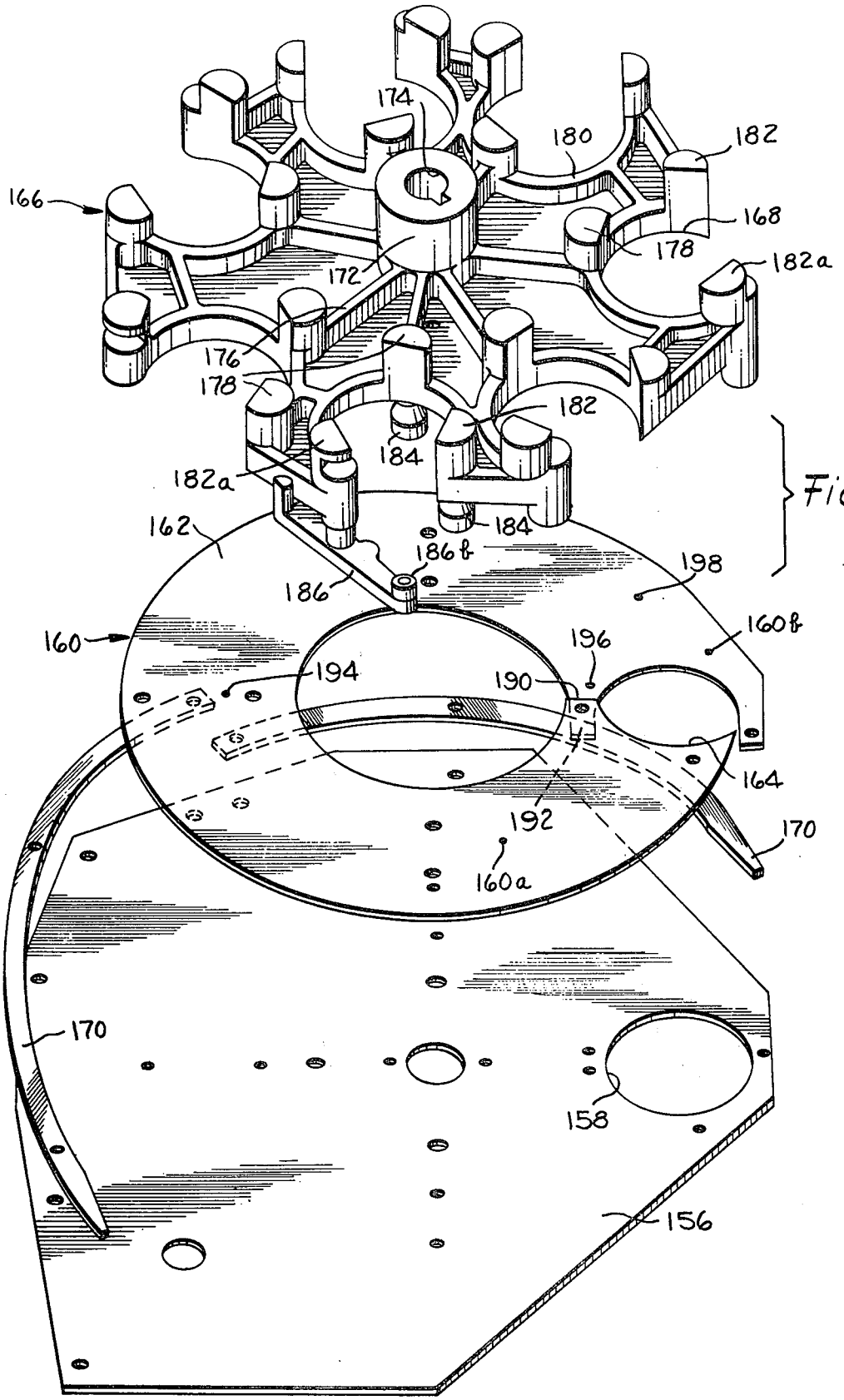
FIG. 9 is an exploded view showing the basic components of the magazine.
Figure 11:
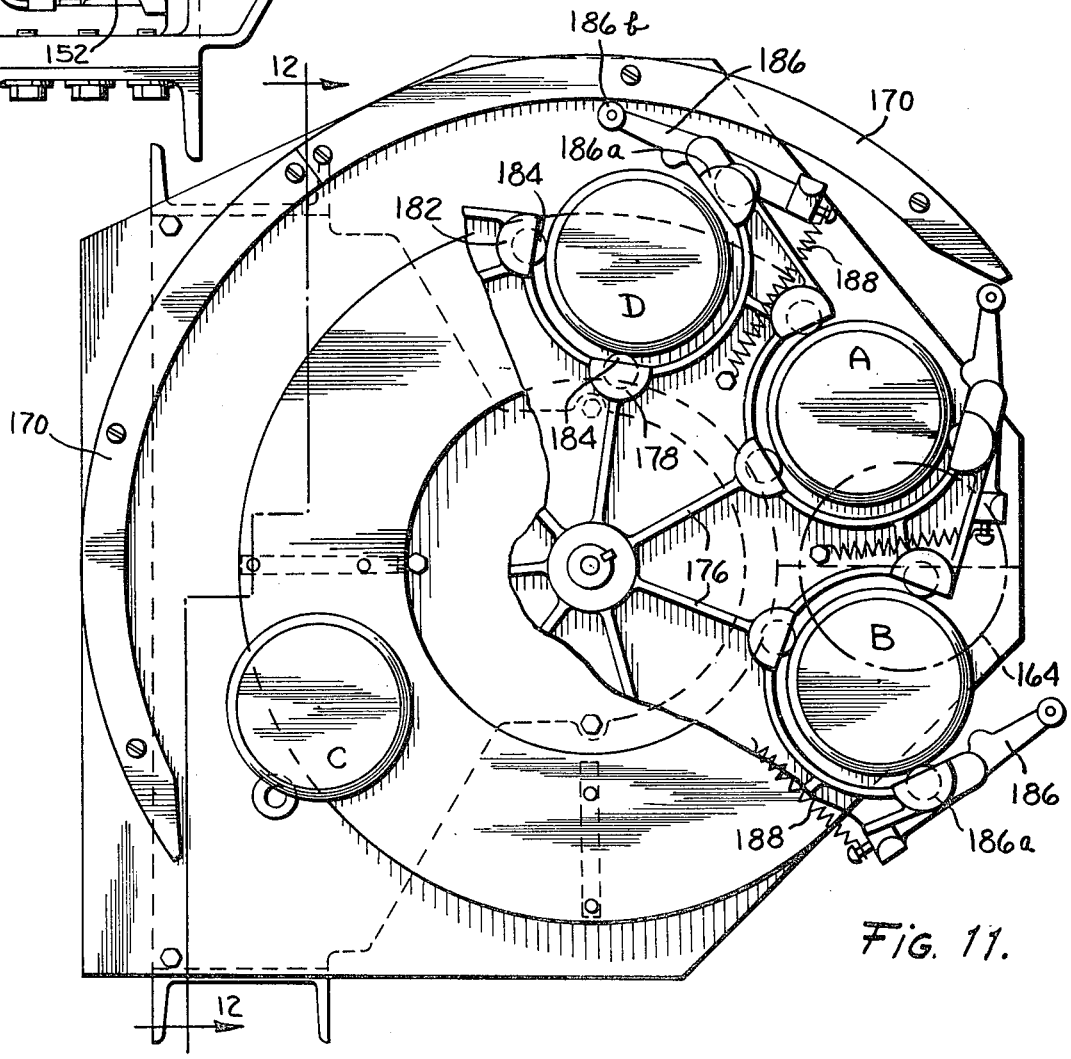
FIG. 11 is a cut-away plan view of the magazine assembly.

A general view of the magazine assembly is shown in FIG. 1 with more detailed views illustrated in FIGS. 9, 11, and 12.

The magazine assembly comprises a stationary floor plate 156, which is attached to legs 144 through a gearbox casting (not numbered) and comprises the frame of the magazine assembly (see FIG. 12). An opening 158 is provided in the floor plate to permit targets to fall through. Rigidly attached to the top of the stationary floor plate 156 is a target ramp 160 which has an inclined portion 162 for a purpose to be described later and an opening 164 through which targets are dropped to the launching platform.

Magazine shaft 222 (FIG. 10) passes through floor plate 156 and center of target ramp 160 and is attached to a magazine casting 166 (see FIG. 9), which in the modification shown has seven cut out sections 168 through which targets can pass and be stacked. The guide posts on the magazine casting are only high enough to support about the lower four or five targets in each stack. The conventional elongated guide rods found in other similar traps are not required because of the manner in which the magazine casting with the stacks of targets is connected to the stationary base 10 through legs 144. The magazine casting and targets do not oscillate with the trap but are stationary except when the target has been thrown and the main housing 12 has stopped oscillating. At this point the magazine casting with the stacks of targets is oscillated one-seventh turn.

This feature has several advantages: (1) There is less vibration transmitted to the targets in the magazine; thus there is less tendency to break targets; (2) There are no support rods needed to keep the stacks from tipping over since the stacks are always vertical and move so slowly and evenly during the feeding rotation that there is no tendency to tip; (3) It permits easier loading and more reliable feeding since targets cannot tip and jam between guide or support rods as they do in other magazines in similar use traps.

Also rigidly attached to the top of the stationary floor plate 156 so as to extend over said floor plate and outwardly of a portion of said target ramp 160 is an elongated, arcuate finger release cam 170 (see FIGS. and 11).

The actual mechanism for holding the stacks of targets in suspension - or free of said target ramp — will now be described.

The magazine casting has a central boss 172 with a keyed opening 174 therein which fits onto magazine shaft. Extending radially from the central boss 172 are a series of reinforcing upstanding radial ribs or spokes 176. Each spoke 176 ends in an interior boss 178, the sum total of which prescribes a circle about the central boss 172. Each interior boss 178 in turn is located centrally of an essentially circular upstanding rib portion 180 which defines target openings which must line up with the openings in the target ramp and floor plate in order for the targets to drop to the launching platform. As shown in FIG. 9, each of the circular rib portions 180 ends with upstanding exterior bosses 182 and 182a at each of the rib.

Elastomeric fixed magazine sleeves 184 are located in each of the interior bosses 178 and one of the exterior bosses, i.e. 182, so as to extend outwardly into the target cut-outs 168 in magazine casting 166. The other exterior bosses 182a have feed fingers 186 pivotally connected thereto and are spring biased by springs 188 to cause the fingers to be forced inside of the target cut-outs 168 in the normal position (see target stack in location B in FIG. 11).

Feed finger 186 includes an elastomeric roller **186*a* centrally positioned thereon to contact the target and a roller 186*a* made of more durable material, e.g. metal, which runs on finger release cam 170. As can be seen in locations A and B of FIG. 11, when the metal finger roller 186*b* is not contacting the finger release cam, the elastomeric roller 186*a* of that feed finger joins with the corresponding magazine sleeves 184 to provide three points of contact to frictionally engage the target and hold it from dropping — along with the targets above the target being held by the "three point contact." Upon roller 186*b* contacting the cam 170 (not shown in location C but shown in location D) the elastomeric roller 186*a* is pivoted away from contact with the target so that the stack is resting by gravity on target ramp 160.**

A further explanation of the target ramp 160 is necessary in order to understand the actual movement and feeding of the lowermost target from each of the stacks when the magazine casting with the stack of targets reaches opening 164 in the target ramp 160 and opening 158 in the floor plate.

In addition to the inclined portion 162, target ramp 160 has an upper flat portion **160*a* and a lower flat portion 160*b* (see FIG. 12). However, lower flat portion 160*b* can be omitted so that the incline or ramp is maintained right down to the ramp target opening 164. Specifically, when viewing FIG. 9, target ramp 160 is shown slitted at 190 at about the central part of opening 164. Going clockwise, the upper flat portion of the target ramp would be the portion from point 192 to point 194. The descending incline or ramp portion 162 would start at around point 194 and go all around to point 196 or if a small lower flat portion 160*b* is desired, the ramp would end at point 198 and the portion from point 198 to 196** would constitute this lower flat portion.

FIG. 11 shows four stacks of targets in locations A, B, C, and D in order to explain the function of the magazine assembly. At location A, the stack is at the lowest level of the ramp 160 and has just been gripped by an elastomeric roller **186*a*, attached to feed finger 186 after the metal roller 186*b* of the feed finger has run off the cam 170. However, at this point, the lowest target in the stack, resting on the ramp is below the contact point of the roller attached to the finger so that the roller contacts and holds the second target from the bottom of the stack and retains the entire stack. As the magazine casting 166 rotates past the drop hole or opening 164** in the target ramp the lowest target falls through the opening onto the drop pad of the launching plate.

At location B, the upper portion of the target ramp is positioned slightly below and out of engagement with the bottom target of the stack which is being supported by the roller on the finger and the two fixed magazine sleeves. At location B the stack has not been released by the magazine finger and the stack is separated from the ramp — in this modification — by about 1/16 inch or so — just enough to insure that the lowermost target will clear the end of the ramp as the stack rotates past the drop opening, i.e. from location A to B. The stack is carried in this manner until location C is reached. At location C, the metal roller **186*b* on the end of the finger contacts the end of the cam (not shown on drawing) causing the finger elastomeric roller 186*a* to be pivoted away from the lowermost target and thus to release the stack allowing it to drop softly and rest on the upper portion of the ramp. The finger 186 and rollers 186*a* and 186*b* are not shown at location C of FIG. 11,** but the relationship can be seen by observing the position of these elements at location D.

At location C the ramp is supported by spacers (not numbered) on the stationary floor plate 156 so that it is elevated above the floor plate a distance equal to the thickness or height of one target.

The major portion of the descent or incline is achieved between locations C and D. The remainder of the descent is achieved between location D and location A, where it was mentioned above the ramp is at its lowest point. The drop opening 164 in the ramp is shown in broken lines between locations A and B in FIG. 11.

Finally, a brief description of the firing mechanism and the wiring requirements is submitted.

By referring to FIG. 13, it can be seen that by throwing the three-pole-double-throw release switch 198 in the position shown and identified as "On," a circuit is formed through main motor 20 so that the motor runs continuously as long as the switch is in the "On" position.

If the auto angle on-off switch 200 is thrown in the position shown, a parallel circuit is formed through timing motor 94 which causes the timing motor to run continuously also along with the timing motor cam 96 to which it is connected. When the trap is in the cocked position and the target is ready to be thrown, push-button switch 52 is actuated which closes the circuit through the switch 52 and actuates cocking clutch solenoid 54 which in turn releases pawl 50 thus connecting cocking clutch gear 28 to the sprocket 46 which in turn is continuously turning because of its connection via chain 48 to motor 20.

As previously stated, cocking clutch pivot cam 86 closes switch 88 almost immediately after pivot shaft 14 begins to rotate and maintains the switch in the closed position for approximately the first ½ of the cocking cycle. As mentioned previously, timing motor cam 96 has irregularly spaced and irregular lengths of abutments which contact and close auto-angle switch 92 at irregularly spaced intervals. Since cocking clutch micro-switch 88 and timing motor micro-switch 92 are in series, it can be seen that if switch 92 is closed during the first ½ of the cocking cycle, i.e. when switch 88 is closed, a circuit is formed which results in the actuation of angling clutch solenoid 90. This solenoid 90 causes the angling mechanism to become engaged through angling clutch 36 thus causing unpredictable amount of oscillation of the main housing 12.

What is claimed is:

1. A target throwing trap comprising a housing, a main shaft mounted on said housing, a target throwing arm secured on one end of said shaft, a crank arm secured to the other end of said shaft, a mainspring connected to said crank arm and to said housing, cocking means for rotating said shaft and associated throwing arm and crank arm so as to tension the mainspring and cock the throwing arm, means associated with said cocking means for stopping the rotation of the shaft just before the axis of the mainspring reaches the top dead center line, means on said shaft to prevent the shaft from being rotated in the opposite direction by the action of the mainspring when the trap is in the cocked position, and means to actuate said cocking means so that upon actuation said shaft is rotated until the mainspring axis passes overcenter whereupon the force of the mainspring acts on the shaft and throwing arm thus providing the necessary centrifugal force to throw a target, said cocking means continuing to rotate the shaft until the cocked position is reached whereupon shaft rotation is stopped, the mainspring is tensioned and held just short of overcenter position and the trap is cocked and ready to be fired again.

2. A target throwing trap as recited in claim 1, wherein said cocking means comprises a main shaft gear mounted on said main shaft so as to rotate freely thereon, a second shaft positioned parallel to and spaced apart from said main shaft, a cocking clutch gear mounted on said second shaft in meshing relationship with said main shaft gear, a drive arm secured to said main shaft, a stud on said main shaft gear for engaging said drive arm upon rotation of said main shaft gear, and means for rotating said cocking clutch gear whereupon said main shaft and attached throwing arm are caused to be moved against the force of the mainspring until the trap is cocked with the mainspring held just short of overcenter position.

3. A target throwing trap as recited in claim 2, said means for rotating said cocking clutch gear comprising a drive means mounted on said second shaft so as to rotate freely, and clutch means operatively and selectively connecting said drive means and said second shaft and attached cocking clutch gear so that upon engagement of said clutch means said second shaft and said cocking clutch gear are driven by said drive means, and means selectively engaging and disengaging said clutch means.

4. A target throwing trap as recited in claim 1, wherein said cocking means comprises a main shaft gear mounted on said main shaft, a second shaft having a cocking clutch gear fixedly mounted thereon in meshing engagement with said main shaft gear, means on said main shaft gear and said main shaft for turning said main shaft upon rotation of said main shaft gear, a drive means rotatably mounted on said second shaft, clutch means operatively and selectively engageable with said second shaft and said drive means so that when said clutch means is engaged said second shaft is rotated and when the clutch means is not engaged said drive means rotates freely on said second shaft, said means stopping rotation of said main shaft comprising means to disengage said cluth means from said second shaft thus stopping rotation of said cocking clutch gear and said main shaft gear.

5. A target throwing trap as recited in claim 1, in which said means on said shaft to prevent the main shaft from being rotated in the opposite direction comprises a one-way clutch which allows free over-run of said shaft in one direction while preventing rotation in the opposite direction.

* * * * *

UNITED STATES PATENT AND TRADEMARK OFFICE

CERTIFICATE OF CORRECTION

PATENT NO. : 4,005,695

DATED : FEBRUARY 1, 1977

INVENTOR(S) : JAMES MARION ALDAY/KENNETH CHARLES ROWLANDS

It is certified that error appears in the above-identified patent and that said Letters Patent are hereby corrected as shown below:

Col. 1, Line 17, "mechines" should read as "machines"; Col. 1, Line 65, after plan insert --view--. Col. 4, Line 45, after continually insert --.--. Col. 7, Line 67, "botton" should read as "button". Col. 9, Line 11, after each insert --end--; Col. 9, Line 23, "186a" should read as "186b". Col. 12, Line 29, "cluth" should read as "clutch".

Signed and Sealed this

Seventeenth Day of May 1977

[SEAL]

*Attest:*

RUTH C. MASON
*Attesting Officer*

C. MARSHALL DANN
*Commissioner of Patents and Trademarks*